United States Patent [19]

Rothe et al.

[11] 3,951,565

[45] Apr. 20, 1976

[54] HIGH SUCTION INDUCER

[75] Inventors: Kurt Rothe, Palisades; Raymond B. Furst, Northridge, both of Calif.

[73] Assignee: Rockwell International Corporation, El Segundo, Calif.

[22] Filed: Dec. 9, 1974

[21] Appl. No.: 530,644

[52] U.S. Cl. ..... 415/1; 415/72; 415/215; 415/219 R

[51] Int. Cl.[2] ..... F04D 1/04; F04D 3/02

[58] Field of Search ..... 415/181, 72, 215, 1; 416/176, 177, 215, 219 R; 115/34, 16; 60/221

[56] References Cited

UNITED STATES PATENTS

| | | | |
|---|---|---|---|
| 3,163,119 | 12/1964 | Huppert et al. | 415/72 |
| 3,442,220 | 5/1969 | Mottram et al. | 415/72 |
| 3,522,997 | 8/1970 | Rylewski | 415/215 |

*Primary Examiner*—Henry F. Raduazo

*Attorney, Agent, or Firm*—L. Lee Humphries; Robert M. Sperry

[57] ABSTRACT

An inducer having a generally conical hub and a plurality of blades projecting substantially perpendicular to the axis of said hub; each of said blades being formed of alar configuration with the tip suction surface leading edges of said blades defining angles of ± 0.5° with the relative flow direction of the incident fluid, and having the ratio of the spacing between adjacent blades to the clearance distance between said blade tips and an encircling housing greater than about 70.

3 Claims, 9 Drawing Figures

HIGH SUCTION INDUCER

BACKGROUND OF THE INVENTION

1. Field of the Invention

This invention relates to pumps and is particularly directed to improved inducers for pumps and the like.

2. Description of the Prior Art

In the pump art, there has been continuous effort to develop pumps which would yield higher suction specific speeds. On the other hand, for a given inlet pressure, conventional impellers cannot provide suction specific speeds in water in excess of 12,000 to 15,000 without encountering destructive cavitation. High suction specific speed inducers (20,000 to 40,000) which have been developed for the rocket engine industry are capable of very short life, approximately two hours, due to destructive cavitation damage.

BRIEF SUMMARY AND OBJECTS OF INVENTION

These disadvantages of the prior art are overcome with the present invention and an inducer is provided which permits operation at suction specific speeds in water in the range of 20,000 to 40,000 for hundreds of hours with little or no cavitation damage.

The advantages of the present invention are preferably attained by providing an inducer formed with blades of alar configuration having relatively sharp leading edges, the tip suction surfaces of which define angles of ±0.5° with the relative flow direction of the incident fluid and having the ratio of the blade tip spacing to the clearance distance between said blades and a surrounding housing greater than about 70.

Accordingly, it is an object of the present invention to provide improved pump means.

Another object of the present invention is to provide pump means yielding suction specific speeds in water in the range of 20,000 to 40,000 for hundreds of hours with little or no cavitation damage.

An additional object of the present invention is to provide improved inducers which permit high speed, long-life pump operation.

A specific object of the present invention is to provide an inducer having a generally conical hub and a plurality of blades projecting substantially perpendicular to the axis of said hub; each of said blades being formed of alar configuration with the tip suction surface leading edges of said blades defining angles of ±0.5° with the relative flow direction of the incident fluid, and having the ratio of the blade spacing to the clearance distance between said blades and a surrounding housing greater than about 70.

These and other objects and features of the present invention will be apparent from the following detailed description, taken with reference to the accompanying drawings.

DETAILED DESCRIPTION OF INVENTION

Figure 1:
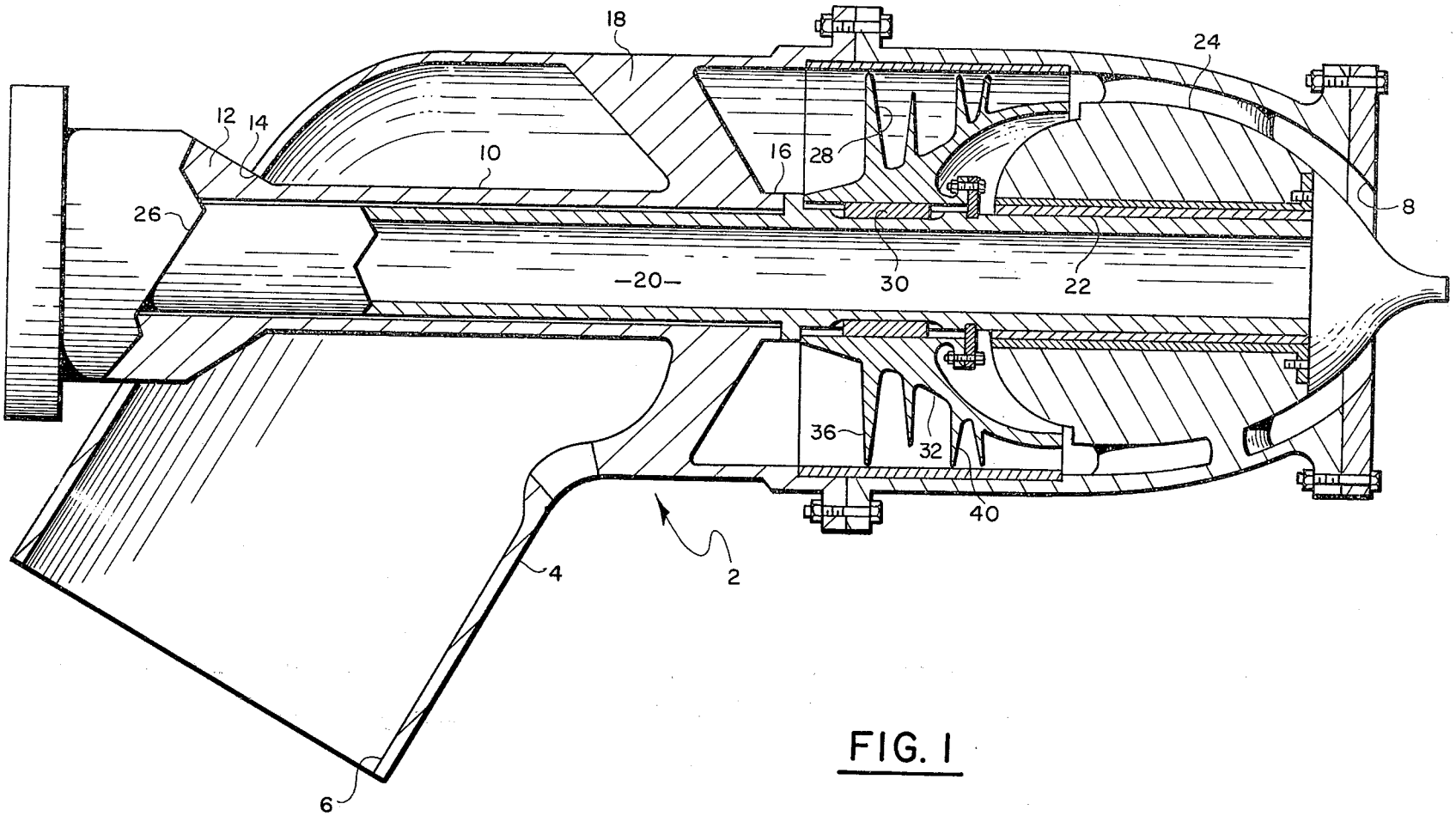
FIG. 1 is a vertical section through a marine jet propulsion unit employing an inducer embodying the present invention.
Figure 2:
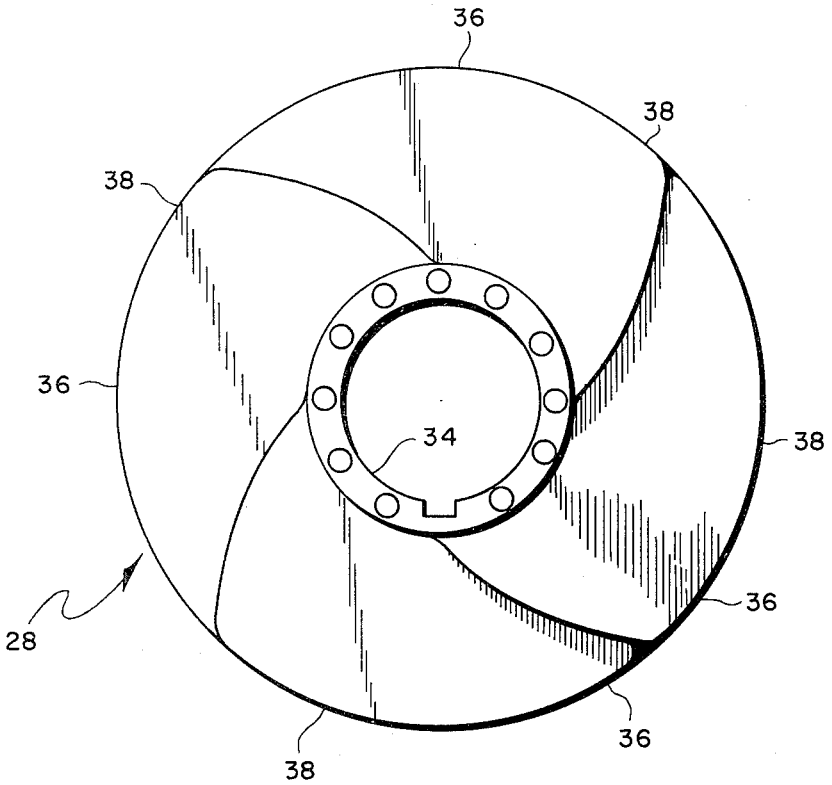
FIG. 2 is a front elevation of the inducer of FIG. 1.
Figure 3:
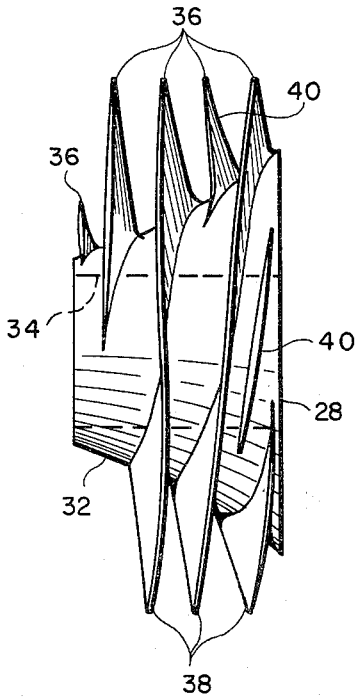
FIG. 3 is a side elevation of the inducer of FIG. 1.
Figure 4:
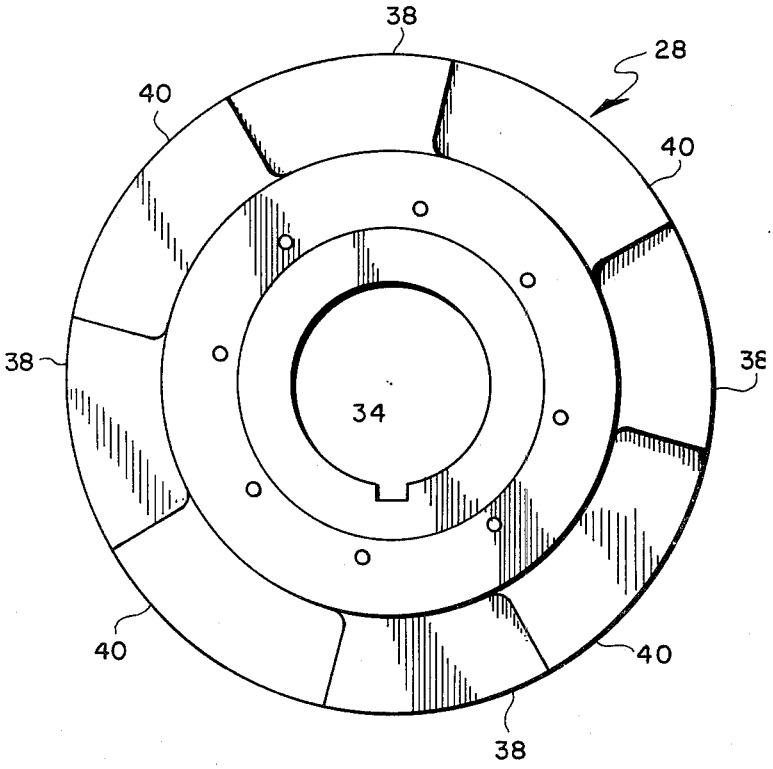
FIG. 4 is a rear elevation of the inducer of FIG. 1.

In that form of the present invention chosen for purposes of illustration in the drawing, FIG. 1 shows a marine jet propulsion unit indicated generally at 2, comprising a generally L-shaped housing 4 having an inlet opening 6 and an outlet opening 8. A hollow sleeve 10 projects into the housing 4 in axial alignment with the outlet opening 8. As shown, one end 12 of this sleeve 10 projects through an opening 14 formed in the housing 4, while the opposite end 16 of the sleeve 10 is suppported within the housing 4 by a single hollow vane 18 surrounding the shaft 20 which extends through the sleeve 10 and has one end 22 parallel in a bearing block 24, while the opposite end 26 of the shaft 20 is mounted for rotation by suitable means, not shown in FIG. 1. An inducer 28 is mounted on the driveshaft 20, intermediate the hollow vane 18 and bearing block 24, and is secured for rotation with the driveshaft 20 by suitable means, such as key 30. The exterior of the bearing block 24 is configured to cooperate with the housing 4 and outlet opening 8 to define a discharge nozzle for the propulsion unit 2.

As best seen in FIGS. 1–4, the inducer 28 comprises a generally frustroconical body 32 having an axial opening 34, for receiving the driveshaft 20, and formed with a plurality of blades 36 projecting outwardly from the body 32 substantially perpendicular to the axis of the body 32. As an example, the inducer 28 has four main blades 38 and four secondary blades 40.

Figure 5:
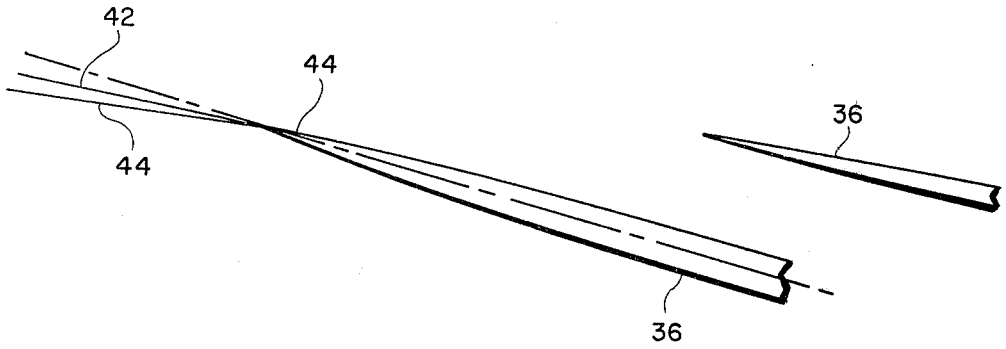
FIG. 5 is a diagrammatic representation showing adjacent blades of the inducer of FIG. 1.

As is well known, inducer blades are formed with a generally alar configuration, using the lift generated thereby to drive the fluid in the desired direction. However, it has been conventional, heretofore, to form the blades with a thick or blunt leading edge, having a wedge angle greater than 10°, in order to improve stress handling and to facilitate casting, and to begin curving the blade immediately rearward of the leading edge in order to provide maximum turning in a minimum length. In contrast, the blades 36 of the inducer of the present invention are formed with a tip leading edge wedge angle of approximately 5° to eliminate blade surface cavitation, provide maximum flow area and prevent local acceleration. In addition, the blades 36 have a sweep angle of about 60° to further prevent local acceleration and to permit the use of thin leading edges while complying with the flow angle requirement set forth below. Sweep angle is the angle between a radial line from the hub center and a tangent to the blade surface at any given point along the leading edge of the blade. To further reduce the likelihood of blade surface cavitation, as seen in FIG. 5, the blades 36 are set at an incidence angle such that the angle formed between the direction of fluid flow, represented by arrow 42, and the suction surface of the blade 36, represented by arrow 44, is less than ±0.5°. The blades 36 are tapered from hub to tip for structural integrity. However, the tip wedge angle of the blades 36 is constrained by the ±0.5° flow angle requirement. At radii other than the tip, the flow angle requirement is $$\pm .5 \times \frac{R_{tip}}{R_{local}},$$

where $R$ tip is the tip radius and $R$ local is the radius at any desired point between the hub and the tip.

Figure 6:
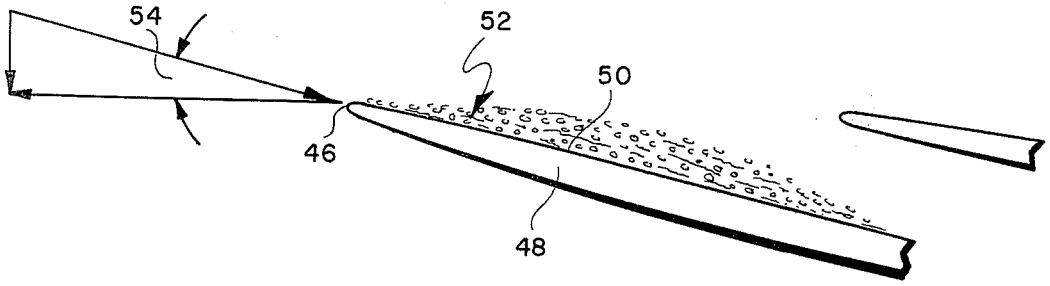
FIG. 6 is a diagrammatic representation showing blade surface cavitation from the leading edge of a conventional impeller blade.
Figure 7:
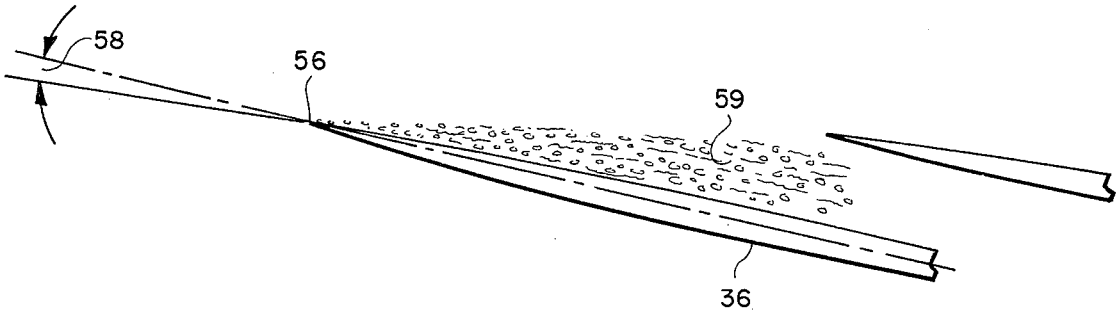
FIG. 7 is a diagrammatic representation showing a view of tip vortex cavitation from the inducer of FIG. 1 looking toward the tip from outside (blade surface cavitation being eliminated)

All of the foregoing constraints serve to prevent or reduce blade surface cavitation, which originates at or near the leading edge 46 of a conventional impeller blade, as seen at 48 in FIG. 6, and collapses on the suction surface 50 of the blade 48 as indicated by the flow of bubbles seen at 52 in FIG. 6. This results from the blunt leading edge 46 and the large incidence angle, indicated at 54. In contrast, as seen in FIG. 7, the blades 36 of the inducer 28 have a sharp leading edge 56 and a small incidence angle, indicated at 58. Thus, blade surface cavitation is eliminated. Any tip vortex cavitation which occurs is carried along with the fluid flow 59 and does not collapse on the blade 36.

Figure 8:
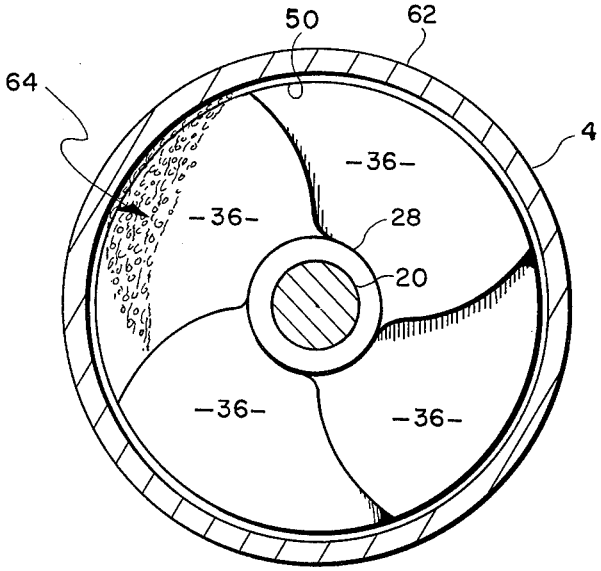
FIG. 8 is a diagrammatic representation showing a front elevation view of tip vortex cavitation.
Figure 9:
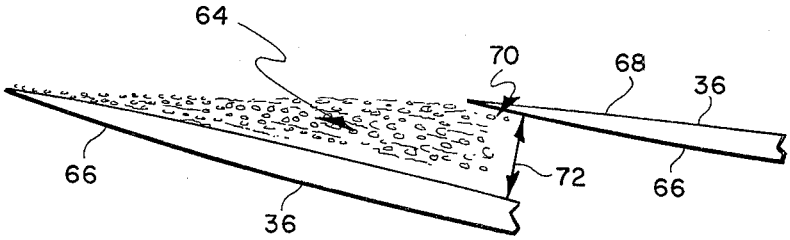
FIG. 9 is a diagrammatic representation showing tip vortex cavitation collapsing upon a following blade.

Another major source of damage in conventional inducers is tip vortex cavitation. As seen in FIG. 8, tip vortex cavitation is caused by fluid spilling between the blade tip 50 and the surrounding wall 62 and passing from the pressure side of the blade to the suction side of the blade in a helical manner, as indicated at 64, and causes damage by collapsing on the pressure surface 66 of a following blade 68, as seen at 70 in FIG. 9. Tip vortex cavitation is a function of the clearance between the blade tip 50 and the surrounding wall 62 and the incidence angle of the blade. On the other hand, if the blade spacing, indicated by arrow 72 in FIG. 9, is adequate for the incidence angle, the tip vortex cavitation will dissipate between the blades without damage. Applicants have found that this result can be reliably attained provided that the ratio of the blade spacing to the clearance distance between the blade tips and the surrounding wall is greater than about 70.

Obviously, numerous variations and modifications may be made without departing from the present invention. Accordingly, it should be clearly understood that the form of the present invention described above is illustrative only and is not intended to limit the scope of the present invention.

We claim:

1. A high suction inducer of the type having a generally conical hub with a plurality of blades being formed of alar configuration and projecting substantially perpendicular to the axis of said hub with a housing encircling said blades, the improvement which comprises;

each of said blades with the tip suction surface leading edges of said blades defining angles of ±0.5° with the relative flow direction of an incident fluid to minimize cavitation damage to the suction side of said blades and having the ratio of the spacing between adjacent blades to the clearance distance between said blade tips and said housing greater than 70 to dissipate harmlessly, tip vortex cavitation that spills between said blades said blades having a sweep angle of about 60°.

2. A method to minimize cavitation damage to blades affixed to and radially extending from an inducer hub of a high suction inducer pump comprising the steps of;

encircling said inducer blades in a housing, shaping the tip suction leading edges of said blades thereby defining angles of ±0.5° with the relative flow direction of the incident fluid, and providing said blades with a sweep angle of about 60°, spacing said radially extending blades such that the ratio of the spacing between adjacent blades to the clearance distance between said blade tips and said housing is greater than 70, thus dissipating tip vortex cavitation spilling between said blades.

3. The method of claim 2 wherein said high suction inducer is operating in the range of 20,000 to 40,000 suction specific speed.

* * * * *